US010211005B2

(12) United States Patent
Jefferies et al.

(10) Patent No.: US 10,211,005 B2
(45) Date of Patent: Feb. 19, 2019

(54) COST REDUCED SYNCHRONIZED-SWITCHING CONTACTOR

(71) Applicant: SCHNEIDER ELECTRIC USA, INC., Andover, MA (US)

(72) Inventors: Kevin M Jefferies, Raleigh, NC (US); Benjamin W Edwards, Rolesville, NC (US); Matthew L White, Cary, NC (US); Alan E Freeman, Raleigh, NC (US); Richard Karl Weiler, Wake Forest, NC (US)

(73) Assignee: Schneider Electric USA, Inc., Andover, MA (US)

( * ) Notice: Subject to any disclaimer, the term of this patent is extended or adjusted under 35 U.S.C. 154(b) by 269 days.

(21) Appl. No.: 15/357,352

(22) Filed: Nov. 21, 2016

(65) Prior Publication Data

US 2018/0144881 A1 May 24, 2018

(51) Int. Cl.

| | |
|---|---|
| ***H01H 9/56*** | (2006.01) |
| ***H01H 47/32*** | (2006.01) |
| *H01H 9/30* | (2006.01) |

(52) U.S. Cl.

CPC ..... *H01H 9/563* (2013.01); *H01H 47/32* (2013.01); *H01H 2009/307* (2013.01)

(58) Field of Classification Search

CPC ... H01H 9/563; H01H 47/32; H01H 2009/307
See application file for complete search history.

(56) References Cited

U.S. PATENT DOCUMENTS

| | | | | |
|---|---|---|---|---|
| 4,356,525 | A | 10/1982 | Kornrumpf et al. | |
| 4,922,363 | A | 5/1990 | Long et al. | |
| 5,440,180 | A | 8/1995 | DeVault et al. | |
| 5,493,485 | A * | 2/1996 | Okado | H02H 7/1227 363/56.01 |
| 5,559,426 | A | 9/1996 | Shea et al. | |
| 5,648,668 | A | 11/1997 | Muramatsu et al. | |
| 6,597,999 | B1 | 7/2003 | Sinha et al. | |
| 2006/0091877 | A1 * | 5/2006 | Robinson | G01R 21/133 324/76.11 |
| 2010/0200383 | A1 * | 8/2010 | Saito | H01H 9/56 200/33 R |
| 2014/0104740 | A1 | 4/2014 | Weichert et al. | |

* cited by examiner

*Primary Examiner* — Zeev V Kitov
(74) *Attorney, Agent, or Firm* — Locke Lord LLP

(57) ABSTRACT

A simple, economically efficient, synchronized switching system for control of a three phase motor contactor utilizes only Voltage monitoring to determine zero crossings and knowledge of the sinusoidal power waveforms and operational delay period of the contactor, to synchronize operation of the contacts at low power. The phases can be serially utilized for zero crossing detection upon Close or Open commands, so as to spread the wear over each set of contacts. Expensive metal at the contact surfaces can therefore be used more efficiently. For arc energy reduction upon contact opening, knowledge of Line-Load Voltage on at least one phase can be used to derive an empirical determination of the voltage angle at opening which yields the lowest arc energy.

8 Claims, 2 Drawing Sheets

COST REDUCED SYNCHRONIZED-SWITCHING CONTACTOR

BACKGROUND OF THE INVENTION

1. Field of the Invention

The present invention relates to the field of contactors and specifically to contactor actuation timing.

2. Discussion of Related Art

A "contactor" is an electrically controlled switch used for switching an electrical power circuit, similar to a relay except with higher current ratings. An electromagnetic 'actuator' is typically that part of the contactor mechanism which electrically controls the switching, i.e. opening and closing the electrical contacts of the switch by activation of a coil in the contactor to operate the movable contacts.

It is a known technique to time the operation of a contactor in an effort to make the closing/opening of contacts at the low power point of the AC cycle (i.e. zero crossing) in order to reduce the damaging effects of arcing on the separable contacts. Arcing at the contacts upon their separation or closure will erode the expensive, high conductivity metals used at the surfaces of the contacts and may eventually require replacement of the contacts or the entire contactor mechanism. Thus, in the known art, the efforts to reduce arcing have tended to be elaborate in terms of equipment or process, or both, and most often involve the monitoring of the current waveform(s) to achieve the maximum accuracy of timing. But, the monitoring of the current involves the provision of current transformers (CTs), which are expensive in terms of money and physical space within the equipment.

Thus in certain instances there may be a need for a more space efficient and cost efficient contactor operation system which can still prevent contact erosion and save costly conductive metal at the separable contacts.

SUMMARY OF THE INVENTION

In the invention the coil operation Command to operate the coil of the contactor to change positions of the moveable contacts (Open or Close) is issued after a calculated delay based solely on monitoring of the Voltage curve of the operating power so that the operational delay of the contactor produces opening or closing of the contacts at the desired (targeted) time of lowest energy on at least one phase and thereby reduces arcing and saves expensive conductive metal at the contacts. This is advantageous in that all the equipment for this method (namely voltage monitors and a micro-controller) is often already in the apparatus and thus there are no additional hardware costs incurred to perform this method. Thus, a simple, economically efficient, synchronized switching system for control of a three phase motor contactor according to the invention utilizes only Voltage detection to determine zero crossings, and utilizes the knowledge of the sinusoidal power waveforms, to predict zero Voltage crossings, and the knowledge of the operational delay period of the contactor, to synchronize operation of the contacts at low power, such as at a zero voltage crossing of one of the phases. The phases can be serially utilized for zero crossing detection upon CLOSE or OPEN commands, so as to spread the wear over each set of contacts. Precious or expensive metal at the contact surfaces, such as silver, can therefore be used more efficiently. For arc energy reduction upon contact opening, knowledge derived from monitoring of the Line-Load Voltage on at least one phase can be used to derive an Empirical determination of the voltage angle at opening which yields the lowest arc energy.

The present invention operates by adding a delay based on the period of a number of Line-Line Voltage zero crossings from one of the incoming power phases minus the operational time of the contactor. In a first aspect of the invention, for the case of closing contacts, the Coil operation Command will occur at the next zero crossing plus a delay equal to (=) a number of zero crossings minus the contactor operating time. For a second aspect of the invention, in the case of opening the contacts, the method uses line-line Voltage monitoring as an input to empirically derive the optimal angle for opening the contacts which achieves the shortest arc duration; so the Coil operation Command delay=(number of zero crossings plus the optimal angle) minus the contactor operating time. In a third aspect, in the case of closing the contacts, the target closing point can be adjusted from a zero crossing to be the optimal angle for minimizing contact bounce duration upon closing and may be determined by one of either a contact bounce time given by the contactor manufacturer or a contact bounce time empirically derived from the Voltage monitoring. In this aspect again, the coil operation Command delay=(number of zero crossings plus the delay angle) minus the contactor operating time.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION

As an initial matter, it will be appreciated that the development of an actual commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Further, words of degree, such as "about," "substantially," and the like may be used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

Figure 1:
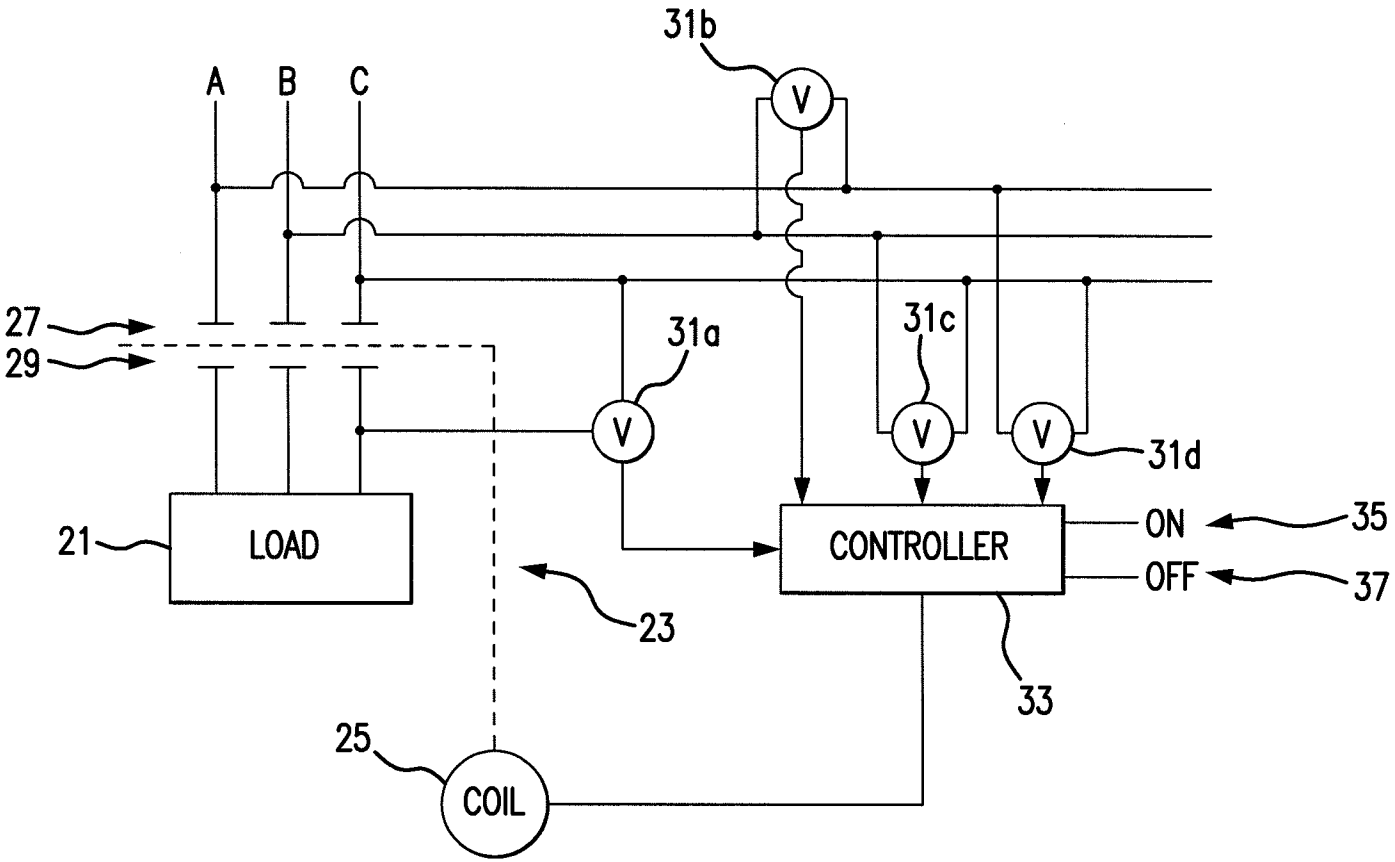
FIG. 1 is a schematic view of aspects of the present invention with a contactor for a three phase induction motor or the like as a load.

As seen in FIG. 1, a load 21 such as a three phase induction motor is controlled by a contactor 23 comprising a coil 25 operating movable contacts 27 to close and open the circuit against fixed contacts 29 at each of the three power phases A, B, and C. A line-load Voltage monitor 31*a*, and line-line voltage monitors, collectively 31*b*-31*d*, are provided on the phases of the incoming power to detect zero crossings and monitor the Voltage as necessary for other functions. A controller 35 is provided for electronic control and operation of the present invention and accepts the outputs of the voltage monitors 31*a*-31*d*. On and Off inputs 35, 37 respectively, are provided for motor control requests, such as through buttons or otherwise as known in the art.

A first aspect of the invention could be accomplished with a motor control device such as the controller 33 that has the following information which may be obtained from the respective providers and is assumed to be stable and constant numbers: Line-Line voltage zero cross time, Voltage frequency, and Contactor operation time which would typically be obtained from the manufacturer for opening and closing operations with opening and closing of contacts generically referred to as "operating the contacts." Contactor operation time is a time from a Coil Operation command signal to an actual contact opening or closing. The contactor operation time of interest in the first embodiment is the closing time.

Figure 2:
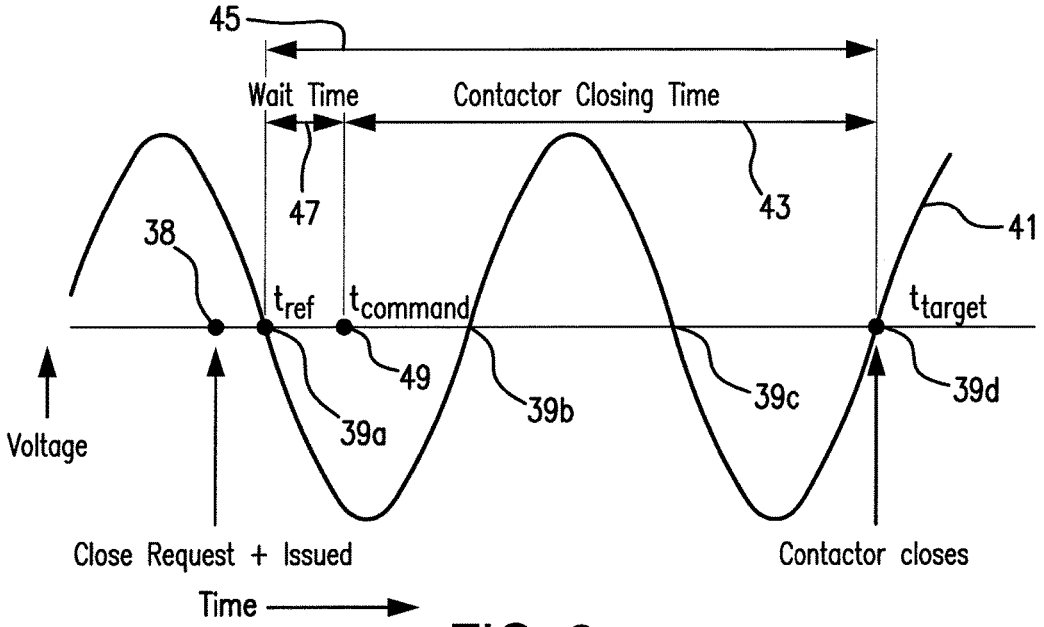
FIG. 2 is a voltage wave form of one phase illustrating request and command timing for contactor operation.

During closing of the electrical contacts the contacts 27, 29 come together at a high velocity. Typically they will bounce apart for a period on the order of milliseconds, creating small arcs, before settling closed. The first embodiment minimizes the arc energy during this closing operation. Referencing FIG. 2, a "close" or ON input request 35 is entered at a first time 38. With a known voltage frequency, it is possible to calculate the time between voltage zero-crossings 39*a*, 39*b*, 39*c*, 39*d* on the waveform 41. It is optimal to close a contactor within a few electrical degrees of a voltage zero-crossing. If the Contactor Operation time, here time to close, represented by line 43, is subtracted from a time between two zero-crossings, i.e. any two crossings, e.g. 39*a* and 39*d*, on the waveform 41 having a distance between them greater than the Contactor Operation time 43, as at line 45, an Operational Delay value 47 is obtained which can be used to determine when the Coil Operation command 49 (here "close contacts" or ON) should actually be sent to the Contactor 23 upon the detection of the next Zero Crossing event 39*a* after the ON or "close" request input 38. So, to operate the contactor coil 25 the Coil Operation command 49 is timed as:

(Zero Crossing event+(Time between Zero Crossings−Contactor closing time)).

Or put another way:

Zero Crossing event+Operational Delay=issue the Coil operation Command

Over time this operation can be performed for the three power phases serially. Successive sharing of the wear on all three phases can either be accomplished by detecting the triggering zero crossing events from each phase serially, or by using zero crossing information from one phase, but adding 0, 120, or 240 electrical-degree-seconds to the command timing to account for all phases. This distribution among the phases will achieve overall lower arc energy for the device and a more even sharing of bouncing arc energy on all three phases. This will result in an increased lifetime of the contacts per unit of costly conductive metal, e.g. silver.

Figure 3:
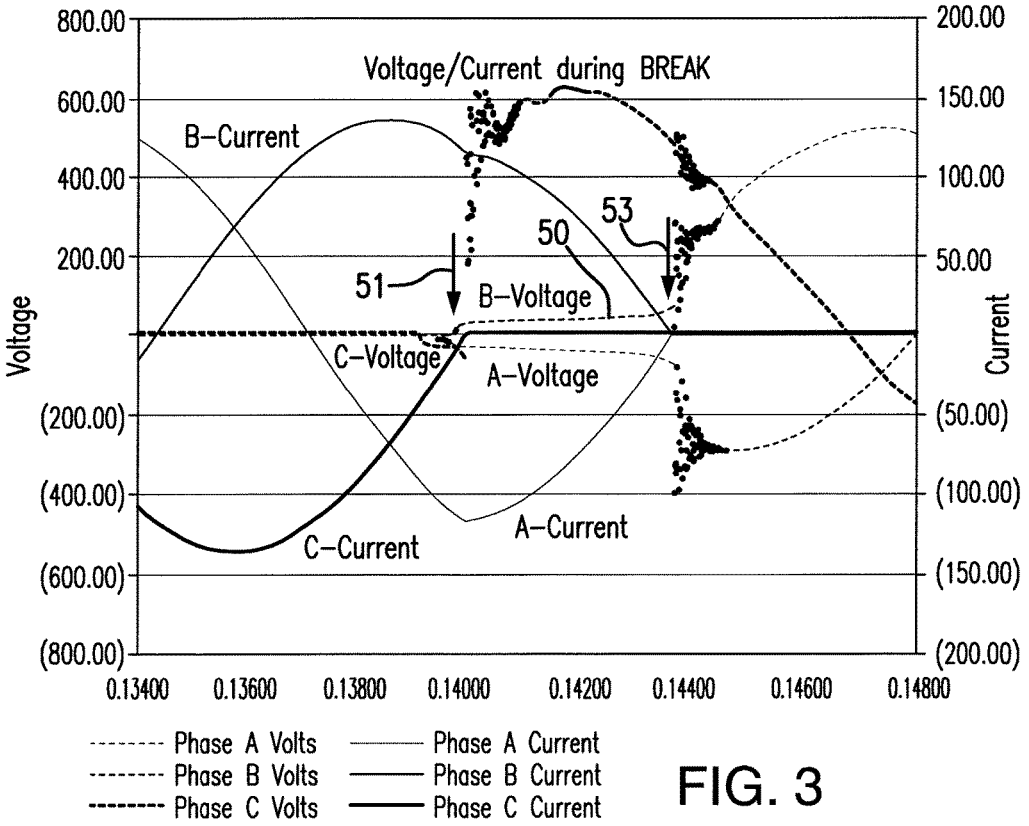
FIG. 3 is a voltage wave form of each phase illustrating arcing disruptions of the wave forms during contact opening.

Referencing also FIG. 3, a second aspect of the present invention could be accomplished in a motor control device with the information in the first aspect, plus the knowledge of the line-load voltage on at least one phase. In this instance it is important to know closing time as well as opening time for contactor operation.

The additional line-load voltage information includes voltage measurement during an electrical arc caused by opening the contacts under voltage. This measurement allows for the recording of an electrical arc duration. This is typically several milliseconds (ms) long. For example in FIG. 3, the phase B voltage 50 during a contact break period between the two arrows 51, 53 is disrupted due to the arcing. With the knowledge of zero-crossing timing & opening time, the voltage angle at opening can be recorded and compared to the electrical arc duration. After several operations, it can be determined that there is an optimal voltage angle at which the electrical arc duration is minimized and this information recorded. Electrical arc duration is directly related to electrical arc energy incident upon the contacts. This optimal voltage angle can then be targeted by the coil control. Over time this operation can be performed successively over all three phases, resulting in (a) overall lower arc energy for the device and (b) an even sharing of arc energy on all three phases. This will result in an increased lifetime of the contacts per unit of silver.

Sharing of the wear on all three phases can either be accomplished by using zero crossing events from each phase and successively cycling through which to use, or by using zero crossing information from one phase, but adding 0, 120, or 240 electrical-degree-seconds to the command timing.

Further, the targeted voltage angle can be adjusted over time, by continually analyzing voltage angle versus arcing energy, to account for changes which affect the optimal angle such as contact wear, power signal changes such as frequency changes, temperature of the contacts due to high frequency operation, or the like.

An enhancement to each of the first and second aspects above, representing essentially third and fourth aspects, would include knowledge of contact bounce duration, with this additional data being given by the manufacturer or extracted from simple voltage measurement used as an indication of arc energy. In the third embodiment, during the manufacturer's characterization of contactor closing time, the contact bounce time could also be characterized. This allows for an adjustment of the target closing angle, before or after 0 degrees, depending on the contact bounce time (for example: it is optimal to center the contact bounce on the zero crossing to ensure minimal arcing). In the fourth embodiment, the bounce duration can be measured directly by measuring the line-load voltage across the contacts, and the target closing angle can be adjusted over time using the same logic as the third embodiment, but dynamically adjusting it instead of basing the target angle on a one-time manufacturer's characterization.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the invention as defined in the appended claims.

The invention claimed is:

1. A method of operating a synchronized switching of movable contacts by a contactor for a three phase load, comprising the steps of:

a) monitoring a voltage waveform of incoming power without monitoring a current waveform of incoming power;

b) determining the incoming power voltage frequency and the incoming power period of a voltage half cycle;

c) determining a voltage zero crossing event for at least one phase of the incoming power;

d) determining a Contactor Operation Time, e) determining an Operational Delay for synchronizing contact operation with a zero crossing of the incoming power (in order to minimize arcing of the contacts), by:

i. determining a number of zero crossings on the AC power waveform equal to a period of time longer than the contactor operation time, ii. subtracting the Contactor Operation Time from the number of zero crossing half cycles; and iii. storing the result as the Operational Delay, f) receiving a Coil operation Request for the contactor, g) then detecting a zero crossing event (for a chosen phase) of the incoming power after receiving the Coil operation Request signal; and h) waiting the Operational Delay time after the zero crossing detection to issue a Coil operation Command to the contactor coil.

2. The method of claim 1 further comprising determining a Contactor Operation Time for both of an opening operation and a closing operation of the contacts.

3. The method of claim 1 further comprising adjusting the Operational Delay time for operating the contacts to achieve a contact operation target angle before or after a zero crossing based on using an empirically derived optimal angle giving the shortest arc duration upon opening of the contacts.

4. The method of claim 3 wherein the Operational Delay= (number of zero crossings plus or minus the delay angle) minus the contactor operation time.

5. The method of claim 1 further comprising adjusting the Operational Delay time for operating the contacts to achieve a contact operation target angle to before or after a zero crossing based on a time period of contact bounce.

6. The method of claim 5 wherein the bounce time is taken from the manufacturers bounce time data, or empirically derived from a measure of line/load voltage disruption.

7. The method of claim 1 further comprising a rotation scheme for the phases to distribute the wear and tear among the phases including one of serially rotating the phases detected or monitoring one phase and adding 0, 120, and 240 degrees of angle serially.

8. The method of claim 1 further comprising empirically determining the optimal angle for operating (opening or closing) the contacts to produce the least amount of arcing during contact operation and adding the optimal angle to a whole number of zero crossings to obtain the Operational Delay.

* * * * *